US011097295B2

(12) United States Patent
Erlhöfer

(10) Patent No.: US 11,097,295 B2
(45) Date of Patent: Aug. 24, 2021

(54) DEVICE FOR STORING AND DISPENSING A LIQUID OR PASTY MASS

(71) Applicant: Louvrette GmbH design x packaging, Kierspe (DE)

(72) Inventor: Fabian Erlhöfer, Gummersbach (DE)

(73) Assignee: LOUVRETTE GMBH DESIGN X PACKAGING, Kierspe (DE)

( * ) Notice: Subject to any disclaimer, the term of this patent is extended or adjusted under 35 U.S.C. 154(b) by 0 days.

(21) Appl. No.: 16/887,329

(22) Filed: May 29, 2020

(65) Prior Publication Data

US 2020/0376510 A1 Dec. 3, 2020

(30) Foreign Application Priority Data

May 29, 2019 (DE) ..... 20 2019 103 061.5

(51) Int. Cl.
*B05B 11/00* (2006.01)

(52) U.S. Cl.
CPC ..... *B05B 11/0038* (2018.08); *B05B 11/0008* (2013.01); *B05B 11/3001* (2013.01); *B05B 11/3045* (2013.01); *B05B 11/0097* (2013.01); *B05B 11/00416* (2018.08); *B05B 11/3047* (2013.01)

(58) Field of Classification Search
CPC ..... B05B 11/0038; B05B 11/0008; B05B 11/3001; B05B 11/3045; B05B 11/0097; B05B 11/00416; B05B 11/3047
See application file for complete search history.

(56) References Cited

U.S. PATENT DOCUMENTS

| | | | | |
|---|---|---|---|---|
| 10,717,098 | B2 * | 7/2020 | Delmon | B05B 11/00416 |
| 2010/0294805 | A1 | 11/2010 | Pohlmann | |
| 2016/0089526 | A1 * | 3/2016 | Hofland | B05B 11/308 604/311 |
| 2017/0165695 | A1 * | 6/2017 | Chen | A45D 34/02 |
| 2017/0348717 | A1 * | 12/2017 | Puviland | A45D 34/00 |

(Continued)

FOREIGN PATENT DOCUMENTS

| | | | |
|---|---|---|---|
| DE | 9211396 | U1 | 12/1992 |
| DE | 4311141 | A1 | 10/1994 |

(Continued)

*Primary Examiner* — Frederick C Nicolas
(74) *Attorney, Agent, or Firm* — Lucas & Mercanti, LLP; Klaus P. Stoffel

(57) ABSTRACT

A device for holding a liquid or pasty mass that can be dispensed from an insertable container by a dispensing device that is part of a first assembly that can be connected with a second assembly that is vertically below the first assembly in an axial direction and has a lower housing part that accommodates the insertable container. First connecting elements allocated to the first assembly are tethered with second connecting elements allocated to the second assembly. The connection that connects the first connecting element carrier with the second connecting element carrier is more easily undone than the positive or latched connection generated during a joining step, which was used to connect the first assembly with the second assembly with an axial force in the vertical direction. The connecting elements have latching teeth that run axially relative to the assembly direction in which the joining step takes place, and mesh into each other in the joining process.

13 Claims, 6 Drawing Sheets

(56) References Cited

U.S. PATENT DOCUMENTS

| | | | | |
|---|---|---|---|---|
| 2018/0290161 | A1* | 10/2018 | Lee | B05B 11/00416 |
| 2018/0344005 | A1* | 12/2018 | Kang | B65D 83/205 |
| 2018/0361413 | A1* | 12/2018 | Ruan | B05B 11/0032 |
| 2019/0200813 | A1* | 7/2019 | Toh | A47K 5/1208 |

FOREIGN PATENT DOCUMENTS

| | | | | |
|---|---|---|---|---|
| DE | 10023551 | A1 | 12/2001 | |
| DE | 102008029004 | A1 | 1/2009 | |
| DE | 202011000379 | U1 * | 5/2012 | B05B 11/3047 |
| EP | 0899206 | B1 | 3/2000 | |
| WO | WO-2020115399 | A1 * | 6/2020 | B05B 11/0038 |

* cited by examiner

Fig: 3
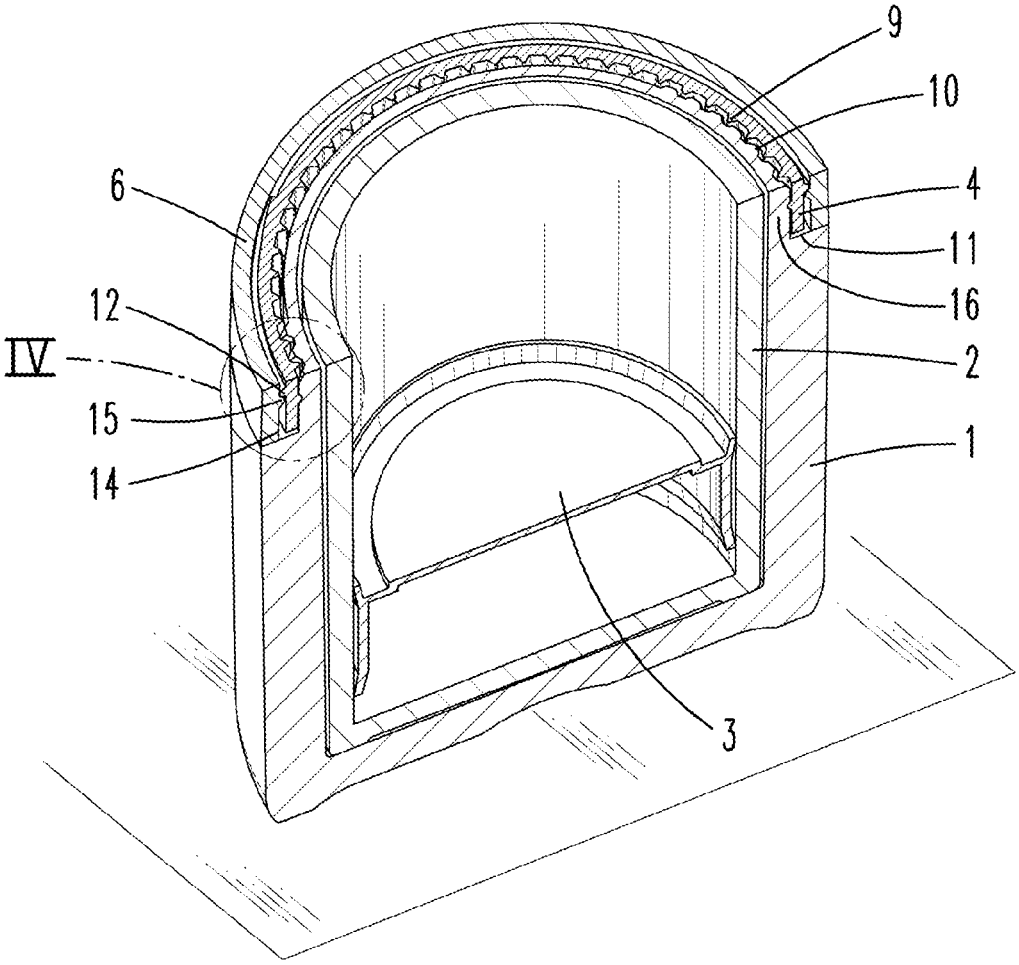
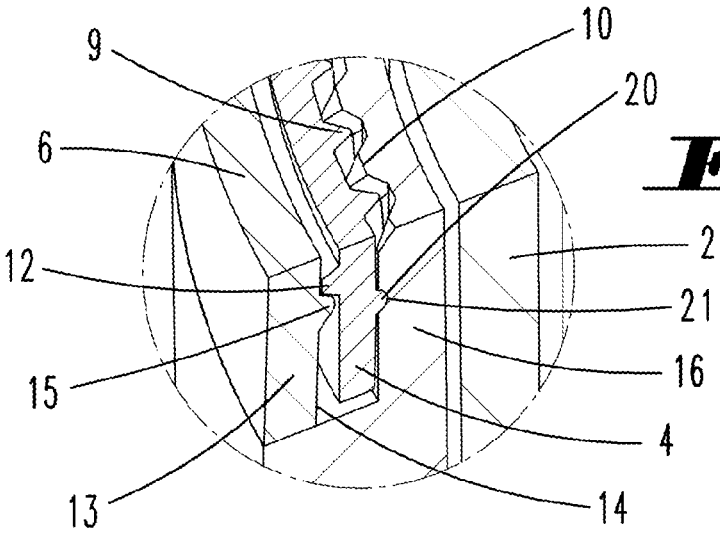
Fig: 4

DEVICE FOR STORING AND DISPENSING A LIQUID OR PASTY MASS

CROSS-REFERENCE TO RELATED APPLICATIONS

The present application claims priority of DE 20 2019 103 061.5, filed May 29, 2019, the priority of this application is hereby claimed and this application is incorporated herein by reference.

BACKGROUND OF THE INVENTION

The invention relates to a device for holding a liquid or pasty mass that can be dispensed from a volume of an insertable container by means of a dispensing device, wherein the dispensing device can be connected with a lower housing part that can accommodate the insertable container, wherein the first connecting elements allocated to the dispensing device are tethered with the second connecting elements allocated to the lower housing part.

Devices of the kind described above are used for holding liquid or pasty masses employed as cosmetics. A generic device has a dispensing device, for example in the form of a pump head, so as to dispense the contents of an insertable container. The insertable container is inserted in a lower housing part. In order to fill the insertable container with the liquid or pasty mass, the device is provided in the form of two connectable parts. A lower part consists of the insertable container arranged in the lower housing part, the opening of which faces upwards. The insertable container can be filled with the mass in this position. The insertable container is sealed in an ensuing production step. This is accomplished by placing the dispensing device on the insertable container or the lower housing part that accommodates the insertable container. Latching means or positive locking means or the like are provided, which connect the dispensing device with the lower housing part via a downward vertical displacement. When connecting the two assemblies, an axial force is applied, which causes the latching means to move toward each other and establish a latched connection.

There is no option for refilling the insertable container.

DE 10023551 A1 describes a device for dispensing a liquid with a pump head and a container for holding the liquid. The pump head has a union nut, which can be screwed onto a male thread of an intermediate piece. The intermediate piece has a female thread, which can be screwed onto a male thread of a lower housing part.

Dispensers for dispensing liquid or pasty media are further known from DE 10 2008 029004 A1, DE 9211396 U1, DE 4311141 A1 and EP 0899206 B1.

SUMMARY OF THE INVENTION

The object of the invention is to expand the scope of application for a generic device.

In particular, the object of the invention is to indicate measures with which the device can be refilled, while still retaining the simple assembly described above, which preferably involves just a single joining step. The relevant advantages to prior art are to be retained.

The object is achieved by the invention indicated in the claims, wherein the subclaims not only describe advantageous further developments of the device indicated in the primary claim, but also constitute separate solutions of the object.

Initially and essentially, it is proposed that the first connecting elements be allocated to a first threaded element, which is detachably threaded with a second threaded element. In particular, it is provided that the dispensing device be detachably connected with the first threaded element. The first threaded element has the first connecting elements, which can be latched or positively connected with the second connecting elements. As an alternative thereto, however, the lower housing part can also have the first threaded element, and the second threaded element can be comprised of the dispensing device. In a preferred embodiment of the invention, the threaded element is an annular body. A first peripheral surface of the annular body can have the first or second connecting elements. The connecting element can have a thread on a second peripheral surface facing away from the latter. In a preferred embodiment, the second threaded element is a component of the dispensing device. The first threaded element can carry a male thread that is screwed into a female thread of a flange section of a retaining element, wherein the retaining element can be a component of the dispensing device. The dispensing device can have a pump head. The retaining element can be used to fasten the pump head to the lower housing part. This can take place with the threaded element interspersed. The threaded element is then connected with the lower housing part, yielding a positive or latched connection. As an alternative thereto, the threaded part can also be connected with the retaining element by means of a positive or latched connection. When filling the device for the first time and then connecting the two assemblies with each other, the threaded element is fixedly connected with one of the two assemblies. It forms the detachable connection that allows refilling on the one hand, and the connecting elements that allow the simple initial assembly on the other. A threaded connection can exist between the lower housing part and the threaded element. This detachable threaded connection, which preferably exists between the threaded element and retaining element or dispensing device, can be undone for purposes of refilling the insertable container. The threaded connection can be undone by turning the retaining element relative to the lower housing part, so that the dispensing device can be removed from the insertable container or lower housing part. The insertable container can then be taken out of the lower housing part and replaced with a new, filled insertable container. At the same time, however, the pump head can also be changed out for a new pump head. The lower housing part is preferably a thick-walled plastic part, and can be reused. The retaining element functions as a coverlet, and can likewise be reused. An intermediate piece that is flashed by the retaining element and has inserted into it the pump head can further be reused. However, insofar as the intermediate piece can come into contact with the mass stored in the insertable container, it is also provided that the intermediate piece be changed out together with the insertable container and pump head. In the refilling process, all parts of the device that come into contact with the contents of the insertable container during its use are preferably replaced. All remaining components can be reused. When undoing the threaded connection, the threaded element, which is preferably a ring part, remains in the position it reached while first assembling the housing parts. In a preferred embodiment, the upper part, i.e., the dispensing device, has a cap that flashes the pump head. During the initial joining step, this cap can rest on the pump head. It is also reused. In one variant of the invention, the insertable container is a rigid body. A follower piston can be arranged in this, in particular tubular, insertable container, and wanders from the floor of the insertable container toward the head of the insertable container during the continued emptying of the insertable container. In this variant of the invention, the insertable container is a tubular bag. The wall of the insertable container is flexible. During the continued emptying of the insertable container, the tubular bag collapses inside of the lower housing part. The vacuum that delivers the force necessary for displacing the follower piston and the force necessary for collapsing the tubular bag is generated by the pump arranged in the pump head.

BRIEF DESCRIPTION OF THE DRAWINGS

An exemplary embodiment of the invention will be described below based on attached drawings. Shown on:

FIG. 3 is a half-section according to line III-III on FIG. 2, FIG. 4 is the cutout IV on FIG. 3.

DETAILED DESCRIPTION OF THE INVENTION

Figure 1:
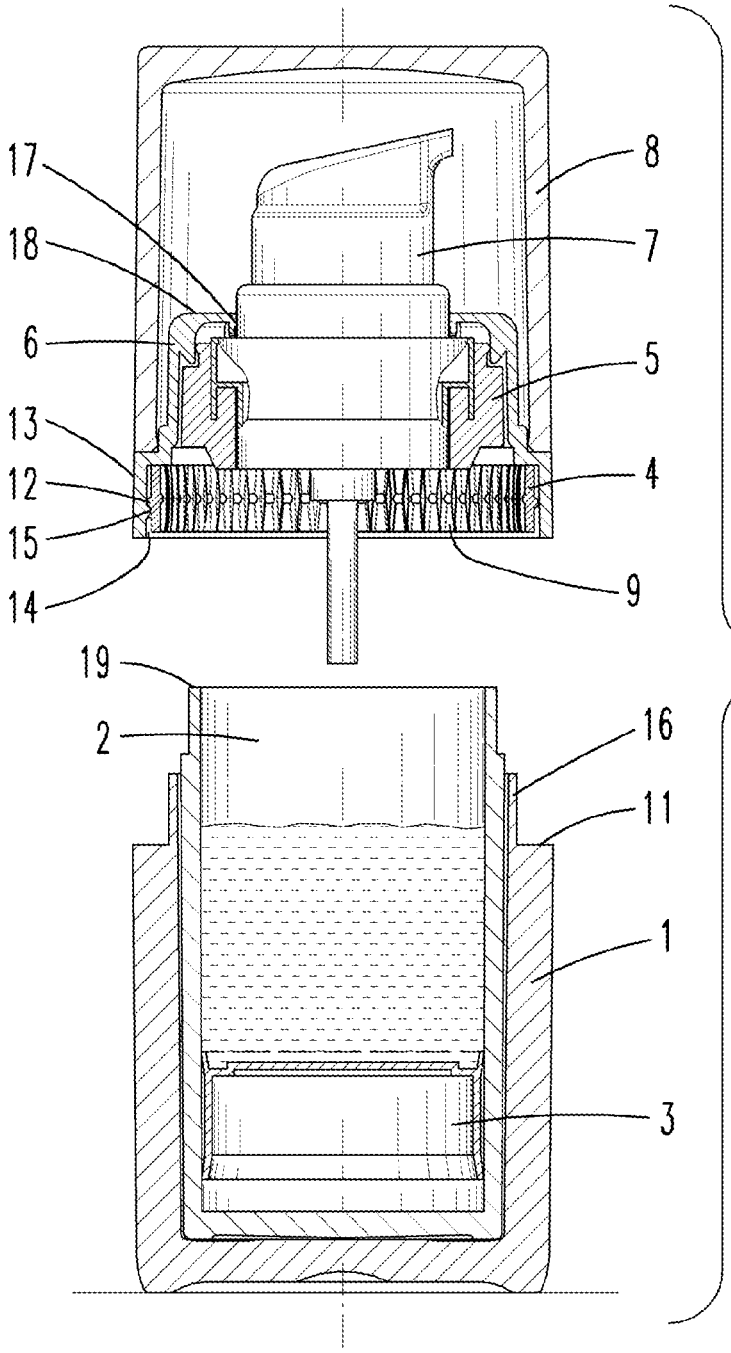
FIG. 1 is a sectional view of a device according to the invention after the filling of an insertable container 2 and before the placement of a dispensing device comprised of a pump head 7 and a retaining element 6.
Figure 2:
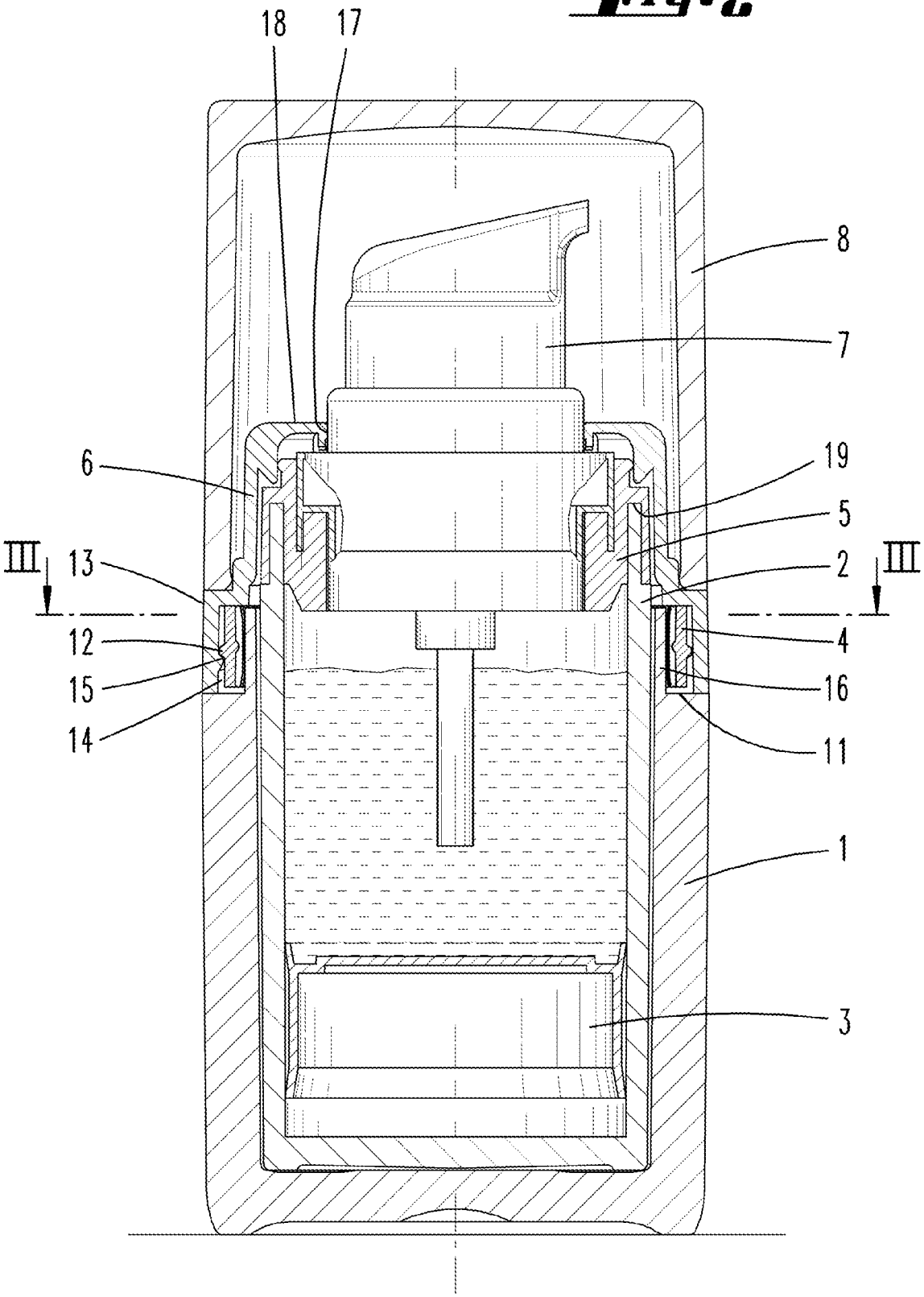
FIG. 2 is an illustration according to FIG. 1 following the assembly of the two components shown on FIG. 1.
Figure 5:
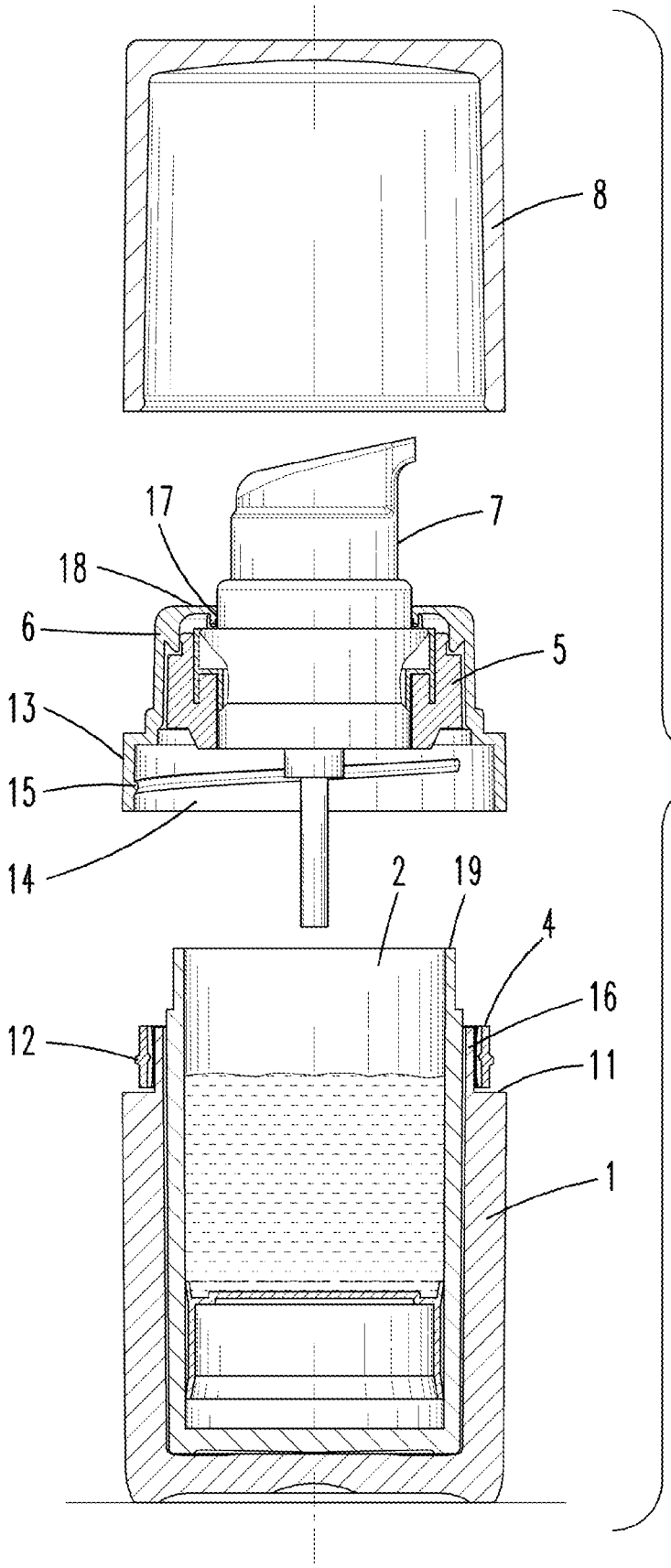
FIG. 5 is an illustration according to FIG. 1, but following the removal of the pump head 7 and retaining element 6 for purposes of refilling the insertable container 2.
Figure 6:
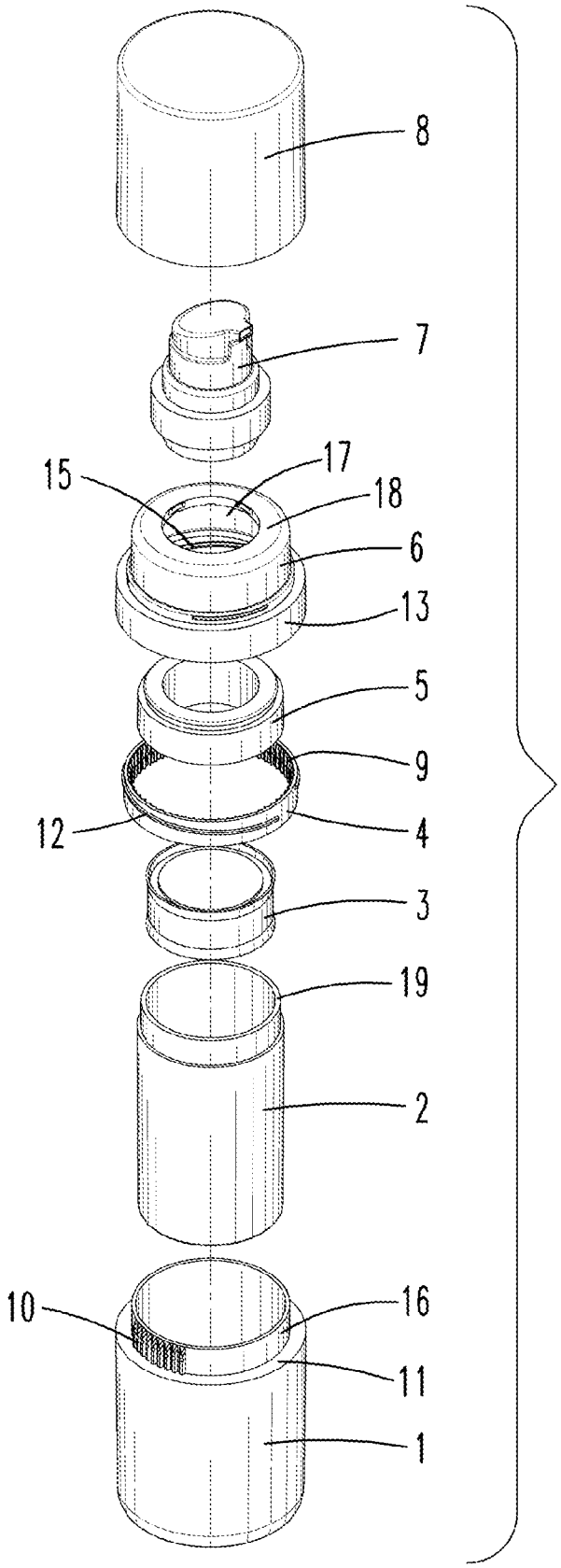
FIG. 6 is a first perspective illustration of components of the exemplary embodiment.
Figure 7:
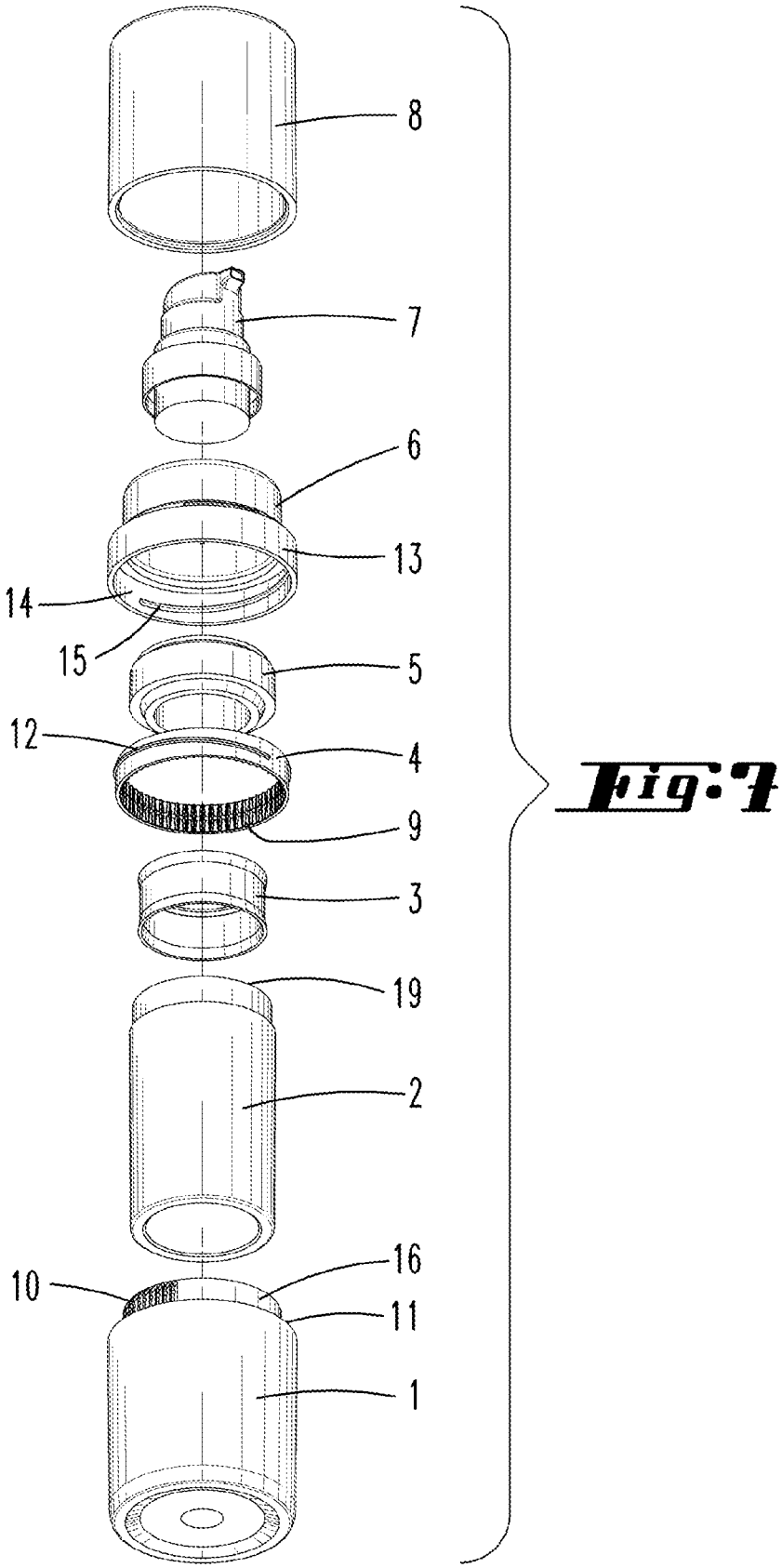
FIG. 7 is a second perspective view of the exemplary embodiment of the invention.

The device according to the invention has a lower housing part 1, which consists of a thick-walled plastic and is shaped like a cup. The lower housing part 1 has a cylindrical shape, a lower floor and an upwardly facing opening. The opening is surrounded by an area 16 with a diminished wall thickness. An outwardly facing step 11 adjoins the area 16 with a diminished wall thickness. The radially outwardly facing wall of the area 16 with a diminished wall thickness has a tooth system 10, wherein the tooth system 10 additionally has an outwardly open peripheral latching groove 21. The tooth system and latching groove 21 form connecting elements, which interact with connecting elements that likewise constitute a tooth system. However, a rib 20 is additionally provided here, which engages into the groove 21 while connecting the connecting elements 9, 10.

An insertable container 2 is provided, which is shaped like a cup just like the lower housing part 1, but has a smaller wall thickness. The insertable container 2 has the kind of outer diameter that allows it to be inserted into the cavity of the lower housing part.

An upper edge 19 of the insertable container 2 protrudes over an upper edge of the lower housing part 1.

A follower piston 3 can be inserted into the insertable container 2.

Reference number 4 denotes a ring part 4, which functions as a threaded part and has the connecting elements 9 that interact with the connecting elements 10. The outer surface of the ring part 4 that faces in the radially outward direction has a threaded rib 12.

An intermediate piece 5 is provided, which has a central opening into which a lower section of a pump head 7 is inserted. The intermediate piece 5 can be supported on the upper edge 19 of the insertable container 2. To this end, the intermediate piece 5 can have a downwardly open annular groove, into which an upwardly facing area of the insertable container with a diminished wall thickness can engage. As a result, the intermediate piece 5 can be tightly placed on the insertable container 2, and upwardly seal the insertable container 2.

A retaining element 6 is used to connect the unit comprised of an intermediate piece 5 and pump head 7 with the lower housing part 1.

A cap 8 is provided, which can be folded over the pump head 7, and can be supported on a peripheral flank of the retaining element 6.

During the manufacture of a device of the kind described above, the assemblies shown on FIG. 1 are initially formed. A first assembly contains the retaining element 6, into which the pump head 7 and the intermediate piece 5 that fixes the pump head 7 in the retaining element 6 are inserted from below. The flange section 13 of the retaining element 6 has located inside of it a threaded element 4, whose thread 12 is screwed into a counter-thread 15.

The second assembly consists of the lower housing part 1 and the insertable container 2 inserted in the lower housing part 1.

The flange section 13 of the retaining element is an annular section with a radially inwardly facing wall, which has a threaded rib 15. A threaded groove can also be provided instead of the threaded rib, however. Involved here is a counter-thread 15 to a threaded rib 12, which arises from the radially outwardly facing wall of the ring part 4. During preassembly, the ring part 4 is screwed into the flange section 13, wherein the two threaded elements 12, 15 are threaded together.

The pump head and the intermediate piece 5 are flashed by a collar 18 of the retaining element. The ring part 4, retaining element 6, pump head 7 and intermediate piece 5 comprise one single unit, which is flashed by the cap 8. The device thus consists of two separate assemblies, which after the insertable container 2 has been filled are connected with each other in a single joining step. In this joining step, the upper assembly comprised of the pump head 7, retaining element 6, intermediate piece 5 and ring part 4 are downwardly folded in a vertical direction over the edge of the insertable container 2, until the radially inwardly facing latching rib 20 latches into the latching groove 21 of the lower housing part. The device is then in a fully assembled state, ready for use.

After the mass stored in the insertable container 2 has been expended, the device can be refilled. In the simplest case, this can be done by filling liquid or the like into the insertable container 2, for which the threaded connection of the threaded elements 12, 15 is undone by turning the retaining element 6 relative to the lower housing part 1. An upper assembly comprised of the retaining element 6, pump head 7 and intermediate piece 5 can then be separated from a lower assembly comprised of the lower housing part 1, insertable container 2 and threaded element 4. The threaded element 4 designed as a ring part remains on the lower housing part 1.

However, refilling preferably takes place by changing out the parts that can come into contact with the contents of the insertable container 2 during the use of the device as intended. Involved here in particular are the insertable container 2, the intermediate piece 5 and the pump head 7. The remaining components of the device, meaning in particular the lower housing part, the cap 8 but also the retaining element 6 and ring part 4, can be reused.

In a preferred further development of the invention, the reusable components of the device have a larger wall thickness than the components to be replaced in the refilling process.

The ring part 4 and area 16 of the lower housing part 1 with a diminished wall thickness are preferably connected by means of teeth 9 that mesh into a tooth system 10. A rib 20 can here protrude from the gaps between two teeth, and can mesh into a groove 21 of the heads of the counter-tooth system.

It is viewed as advantageous that the first assembly have a connecting element carrier 4, which is connected with the assembly in an easily detachable manner. The connecting element carrier 4 can consist of a flat strip bent into a ring. The strip can have a single threaded rib 12 on its radially outwardly facing side. The radially inwardly directed side of the connecting element carrier 4 has teeth that extend in a radial direction, which while joining the first assembly with the second assembly enter into gaps of a tooth system allocated to the second assembly. The intermeshing teeth 9, 10 of the connecting element carrier on the one hand and the lower housing part 2 on the other are latched together during the joining process.

The above statements serve to explain the inventions encompassed by the application as a whole, which each also independently further develop the prior art via at least the following feature combinations, wherein two, several or all of these feature combinations can also be combined, specifically:

A device, characterized in that the connection that connects the first connecting element carrier 4 with the second connecting element carrier 13 is more easily undone than the positive or latched connection generated during a joining step, which was used to connect the first assembly with the second assembly with an axial force in the vertical direction.

A device, characterized in that the first connecting element carrier 4 is a ring part that is screwed with a male thread 12 into a female thread 15 of a flange section of the second connecting element carrier 13.

A device, characterized in that the connecting elements 9, 20; 10, 21 have latching teeth that run axially relative to the assembly direction in which the joining step takes place, and mesh into each other in the joining process.

A device, characterized in that the connecting elements 9, 20; 10, 21 have a latching rib 20 that meshes into the latching groove 21.

A device, characterized in that the threaded element 4 is an annular body, which has latching teeth that extend on a first peripheral surface in an axial direction, and a thread on a second peripheral surface facing away from the latter.

A device, characterized in that the dispensing device 6, 7 has a pump head 7 and a retaining element 6, wherein the retaining element 6 connects the pump head 7 to the lower housing part 1 with the first connecting element carrier 4 interspersed so as to yield the positive or latched connection.

A device, characterized in that the lower housing part 1 has a cylindrical shape with an upwardly facing opening, wherein the opening is surrounded by an area 16 with a diminished wall thickness, which forms a tooth system 10 that interacts with the connecting elements 9 of the first connecting element carrier 4, wherein the insertable container 2 can be removed through the opening.

A device, characterized in that the insertable container 2 has an upper edge 19, on which the pump head 7 is supported.

A device, characterized by a cap 8, which at least regionally flashes the dispensing device 6, 7 in the joining step.

All disclosed features are essential to the invention (separately, but also in combination). The disclosure of the application hereby also completely incorporates the disclosure content of the accompanying/attached priority documents (copy of preliminary application), also for the purpose of including features of these documents in claims of the present application. Even without the features of a referenced claim, the subclaims with their features characterize separate inventive further developments of prior art, in particular so as to generate partial applications based upon these claims. The invention indicated in each claim can additionally have one or several of the features indicated in the above specification, in particular those provided with reference numbers, and/or in the reference list. The invention also relates to embodiments in which individual features mentioned in the above specification have not been realized, in particular to the extent they are obviously unnecessary for the respective intended application or can be replaced by other technically equivalent means.

The invention claimed is:

1. A device for holding a liquid or pasty mass that can be dispensed from a volume of an insertable container, comprising: the insertable container; a dispensing device for dispensing the mass from the insertable container, wherein the dispensing device is part of a first assembly; a lower housing part that accommodates the insertable container and is part of a second assembly that is arranged vertically below the first assembly in an axial direction; first connecting elements allocated to the first assembly and tethered with second connecting elements allocated to the second assembly; and a first connecting element carrier, wherein the first connecting elements are allocated to the first connecting element carrier and are detachably connected with a second connecting element carrier of the first assembly, wherein a connection that connects the first connecting element carrier with the second connecting element carrier is more easily undone than a positive or latched connection generated during a joining step that connects the first assembly with the second assembly with an axial force in a vertical direction.

2. The device according to claim 1, wherein the first connecting element carrier is a ring part screwed with a male thread into a female thread of a flange section of the second connecting element carrier.

3. The device according to claim 2, wherein the first and second connecting elements have latching teeth that run axially relative to an assembly direction in which the joining step takes place, and mesh into each other during joining.

4. The device according to claim 3, wherein the first and second connecting elements have a latching rib (20) that meshes into a latching groove.

5. The device according to claim 3, wherein the threaded element carrier is an annular body that has latching teeth that extend on a first peripheral surface in an axial direction, and a thread on a second peripheral surface facing away from the first peripheral surface.

6. The device according to claim 2, wherein the dispensing device includes a pump head and a retaining element, wherein the retaining element connects the pump head to the lower housing part with the first connecting element carrier interspersed so as to yield the positive or latched connection.

7. The device according to claim 1, wherein the lower housing part has a cylindrical shape with an upwardly facing opening, wherein the opening is surrounded by an area with a diminished wall thickness, which forms a tooth system that interacts with the connecting elements of the first connecting element carrier, wherein the insertable container is removable through the opening.

8. The device according to claim 6, wherein the insertable container has an upper edge on which the pump head is supported.

9. The device according to claim 1, further comprising a cap that is configured to at least regionally flash the dispensing device in the joining step.

10. The device according to claim 1, wherein the insertable container is a cup-shaped body with rigid walls or a tubular bag with flexible walls.

11. A method for manufacturing a device according to claim 1, comprising the steps of: generating the first assembly that has at least the dispensing device, the first connecting element carrier, the second connecting element carrier with first connecting elements that is detachably connected thereto; generating the second assembly that has at least the insertable container and the lower housing part with two connecting elements that accommodates the insertable container; and joining the first and second assemblies together with an axial force in a vertical direction in a single joining step.

12. The method according to claim 11, wherein latching teeth of the connecting element of the first connecting element carrier mesh into latching teeth of the lower housing part, and a latching rib meshes into a latching groove.

13. The method according to claim 11, wherein the first assembly has a cap, the method including placing the cap on the dispensing device.

* * * * *